United States Patent [19]

Fauser

[11] Patent Number: 4,580,740

[45] Date of Patent: Apr. 8, 1986

[54] DOUBLE TRANSPORT DRUM-ROLLER MACHINE

[75] Inventor: Hans Fauser, Heidenheim, Fed. Rep. of Germany

[73] Assignee: J. M. Voith GmbH, Heidenheim, Fed. Rep. of Germany

[21] Appl. No.: 497,742

[22] Filed: May 24, 1983

[30] Foreign Application Priority Data

Jun. 11, 1982 [DE] Fed. Rep. of Germany ..... 3221929

[51] Int. Cl.[4] ..... B65H 18/20

[52] U.S. Cl. ..... 242/66

[58] Field of Search ..... 242/66

[56] References Cited

U.S. PATENT DOCUMENTS

| | | | |
|---|---|---|---|
| 1,851,605 | 3/1932 | Valentine | 242/66 |
| 2,621,736 | 12/1952 | Scruggs et al. | 164/65 |
| 3,178,125 | 4/1965 | Greding | 242/66 |
| 3,937,410 | 2/1976 | Justus | 242/66 |

FOREIGN PATENT DOCUMENTS

| | | | |
|---|---|---|---|
| 472844 | 12/1927 | Fed. Rep. of Germany | 242/66 |
| 742833 | 12/1943 | Fed. Rep. of Germany . | |
| 844702 | 7/1952 | Fed. Rep. of Germany . | |
| 944472 | 5/1956 | Fed. Rep. of Germany | 242/66 |
| 2313943 | 9/1974 | Fed. Rep. of Germany . | |
| 875605 | 9/1942 | France . | |
| 2018728 | 10/1979 | United Kingdom | 242/66 |

*Primary Examiner*—John M. Jillions

*Attorney, Agent, or Firm*—Albert L. Jeffers; Stephen T. Belsheim

[57] ABSTRACT

A double drum winder machine for web-formed material, especially paper webs, including a support. The machine further includes two winder drums which are disposed on the support and form therebetween a drum bed. A wound roll is operatively supported in the drum bed. One of the winder drums receives the web-formed material and directs the material towards the wound roll so that the material is wound onto the wound roll. A load drum is disposed on the support and rides on the wound roll. A relief drum is in cooperation with and is disposed on the same side of the wound roll as the one winder drum. The relief drum is operatively installed on rocking levers which are pivotally connected to the support. A drive mechanism operatively engages the rocking levers to pivot the levers toward and away from the wound roll so as to selectively and responsively press the relief drum against the wound roll whereby the weight of the wound roll against the one winder drum is adjustable during the winding operation.

5 Claims, 2 Drawing Figures

DOUBLE TRANSPORT DRUM-ROLLER MACHINE

BACKGROUND OF THE INVENTION

The present invention relates to a drum-roller machine, and more particularly to a double transport drum-roller machine.

The tightness with which a web-formed material is rolled is important for and in maintaining the quality of the material when rolled on the roller, as well as the stability of the roller itself. In regulating the tightness with which the material is rolled, it is known in the art how to feed the web-formed material to the roller under tension, how to drive the two transport drums on a differential basis, and how to decrease the surface pressure of the roller on the drum by removing weight from the roller, which weight increases quadratically with increasing roller diameter.

In known double transport drum-roller machines, a mechanism engages both ends of the roller for relieving weight therefrom. For this purpose, the web-formed material is rolled onto a roller shaft having terminal segments projecting from both ends thereof so that counterforces may be applied thereto to counteract the weight force of the roller. The weight relieved in such a manner from the roller is also relieved from both transport drums. However, the weight relief provided will be diminished or fail if the axial length of the roller is quite large. This may be temporarily overcome by utilizing a roller shaft having physical characteristics extremely resistant to bending, but such shafts are undesirably too heavy and costly to use.

An object of the present invention is to provide a double transport drum-roller machine in which the use of a roller shaft extremely resistant to bending is unnecessary, and yet provides along the total axial length of the roller uniform relief from it's weight.

The present invention is based on the fact that the surface pressure applied to the web-wrapped drum exerts a much greater influence on the roller tension, which tension determines the tightness of the rolling operation, than the surface pressure applied by the roller on the drum not wrapped by the web-formed material. Therefore, weight relief applied to the roller is made where the influence on the tightness of the rolling is greatest. The surface pressure of the roller against the web-wrapped drum is decreased by counteracting the weight of the roller against the drum by engaging a relief drum on the roller. By appropriately controlling the forces of a load drum and the relief drum against the roller, the surface contact or weight of the roller on the web-wrapped drum can be sensitively and responsively influenced and adjusted in such a manner that the web-formed material is initially wound more tightly on the roller, and as the winding process progresses, the material is wound less tightly about the roller. Further, because the relief drum is engaged peripherally along the axial length of the roller, the double transport drum-roller machine of the present invention can be used with very large roller widths or axial lengths.

In the double transport drum-roller machine of the present invention, the load or weight of the roller is primarily retained or supported by the drum not wound with the web-formed material, thereby to support the roller along its's total axial length to prevent any bending thereof. Moreover, at any point along the axial length of the roller, the tightness of the wind can be uniformly adjusted to the same degree.

In view of the above, the double transport drum-roller machine of the present invention has unlimited application for rollers of any axial length.

Another advantageous feature of the present invention is the provision of rocking levers pivotally connected to the roller machine and which carry the relief drum thereon. The pivot axes of the rocking levers are installed coincident with the axis of the web-wrapped transport drum to provide a compact arrangement. Furthermore, since the relief drum is operative on the roller during the rolling process, a drive mechanism is provided to equalize the peripheral rate of the relief drum with that of the roller.

BRIEF DESCRIPTION OF THE DRAWING

The above mentioned and other features and objects of this invention, and the manner of attaining them, will become more apparent and the invention itself will be better understood by reference to the following description of an embodiment of the invention taken in conjunction with the accompanying drawings.

DESCRIPTION OF A PREFERRED EMBODIMENT

Figure 1:
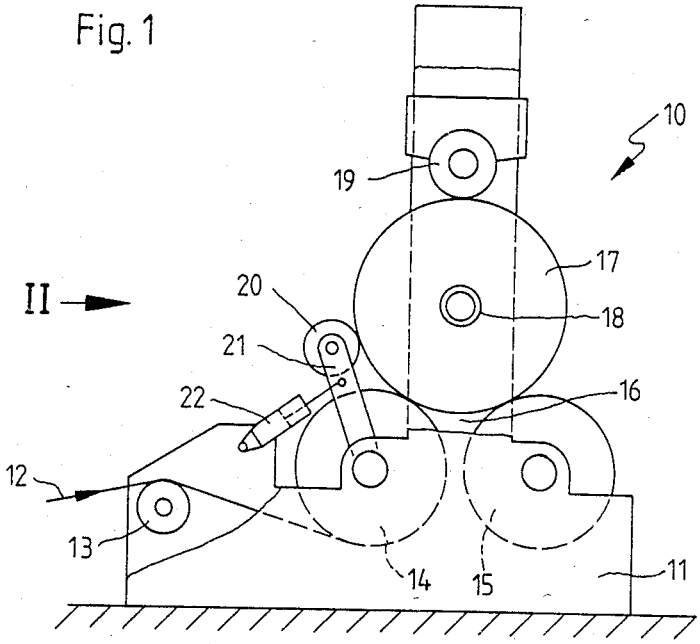
FIG. 1 schematically illustrates a side elevational view of a preferred embodiment of the present invention.
Figure 2:
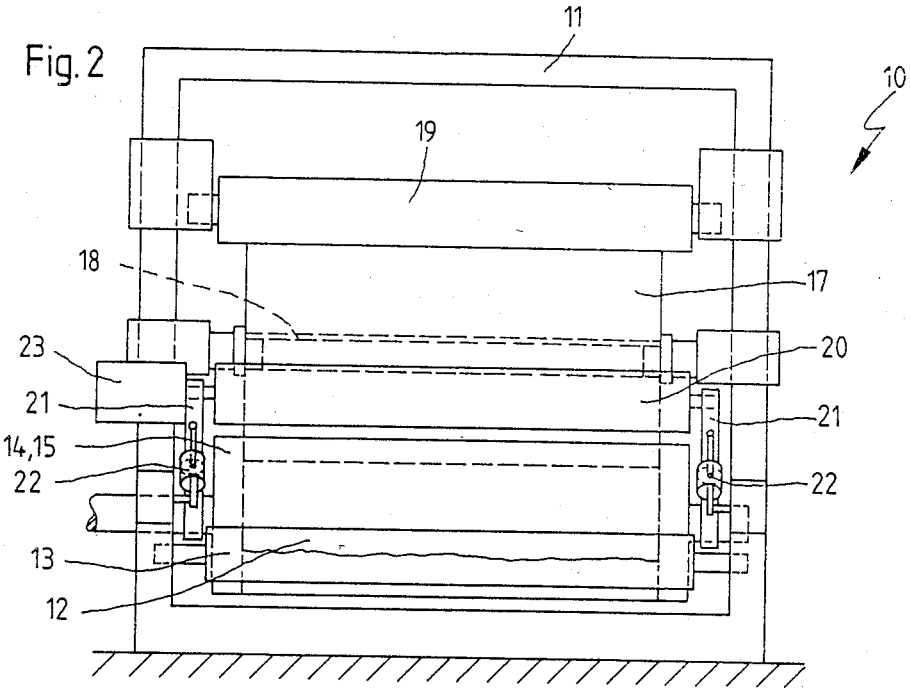
FIG. 2 schematically illustrates a front elevational view of a preferred embodiment of the present invention.

Wrapping machine 10 includes support 11 having guide roller 13 disposed on the side to which paper web 12 is fed. Two transport drums, 14, 15 are installed on support 11 and can be activated by means not illustrated but known in the art. The axes of transport drums (or winder drums) 14 and 15 operate in a substantially horizontal plane, and drums 14, 15 form therebetween drum bed 16. Disposed in drum bed 16 and supported therein by support 11 is roller 17 or wound roll comprising wrapping core 18 wound by paper web 12. As illustrated, roller 17 is vertically disposed above drums 14, 15 and supported by support 11 in a conventional manner not illustrated. Load drum 19 is supported by support 11 and is disposed on roller 17 to ride thereagainst. A pair of rocking levers 21 are pivotally connected to support 11 and carry relief drum 20 on their remote ends. It should be noted that relief drum 20 is disposed on the same side of roller 17 as is transport drum 14, and that the pivot axes of levers 21 are coincident with the axis of transport drum 14. Thrust motor 22 is supported on support 11 and is operatively engaged with rocking levers 21 to pivot them towards and away from roller 17. Finally, a drive mechanism 23 is operatively engaged with relief drum 20 to equalize it's peripheral rate of movement with that of roller 17 throughout the winding process.

In operation, paper web 12 is fed to roller machine 10 by guide roller 13, is wound under and around transport drum 14, and then at the end of drum bed 16 is wound on roller 17. At the beginning of the rolling process, paper web 12 is wrapped under high surface pressure onto roller core 18, the high surface pressure being provided by load drum 19 riding on top of roller 17. With increasing weight on roller 17, the pressure applied against drum 19 is decreased in order to reduce the tightness of the wound web 12 on roller 17, such that the tightness is decreased from the core 18 to the external diameter of roller 17. So that there is no increase in contact pressure of roller 17 on web-wrapped transport drum 14, which is important for the tightness of the winding, due to the increasing weight of roller 17, relief drum 20 operatively engages roller 17 during the rolling process. Prior to engaging relief drum 20 with roller 17, relief drum 20 is initially rotated by drive mechanism 23 the same peripheral rate as roller 17, and thereafter thrust motor 22 swivels levers 21 toward roller 17 to bring relief drum 20 thereagainst. Since relief drum 20 is installed near the periphery of web-wrapped transport drum 14, relief drum 20 counteracts the weight component of roller 17 directed toward and against transport drum 14 to relieve it of the weight or pressure of roller 17. With increasing diameter of roller 17 during the winding process, contact pressure of roller 17 on drum 14 is decreased sensitively and responsively by selectively controlling thrust motor 22 in cooperation with load drum 19.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A double drum winder machine for web-formed material, especially paper webs, including a support, two winder drums disposed on said support and forming therebetween a drum bed, a wound roll operatively supported in said drum bed, one of said winder drums receiving the web-formed material and directing the material to enter the roll bed from below and towards the wound roll so that the material is wound onto the wound roll, and a load drum disposed on said support and riding on said wound roll, characterized in that:

a relief drum is in cooperation with and disposed on the same side of said wound roll as said one winder drum, said relief drum being operatively installed on rocking levers pivotally connected to said support, and a thrust motor operatively engaged with said rocking levers to pivot said levers toward and away from said wound roll to selectively and responsively press with an adjustable force said relief drum against said wound roll during winding whereby the weight of said wound roll against said one winder drum is adjustable during the winding operation.

2. The machine of claim 1 wherein the pivot axes of said rocking levers are coincident with the axis of said one winder drum.

3. The machine of claim 1 including a drive means operatively connected to said relief drum to accelerate the rotation of said relief drum so that it reaches a peripheral speed substantially equal to that of said wound roll prior to said relief drum pressing against said wound roll.

4. A double drum winder machine for web-formed material, especially paper webs, comprising:

a support, a pair of winder drums mounted to said support so as to form therebetween a drum bed, a wound roll mounted to said support so as to be operatively supported in said drum bed, one of said winder drums receiving the web-formed material and directing the material to enter the roll bed from below and towards the wound roll so that the material is wound onto the wound roll, a load drum mounted to said support and riding on said wound roll; and a relief drum means, mounted to said support, for selectively exerting an adjustable force against the wound roll so as to relieve said one winder roll of a portion of the force exerted thereon by said wound roll while still permitting the wound roll to contact said one winder drum during winding.

5. The double drum winder machine of claim 4 where in said relief drum means includes:

a relief drum in cooperation with and disposed on the same side of said wound roll as said one winder drum and being operatively installed on rocking levers pivotally connected to said support; and a thrust motor operatively engaged with said rocking levers to pivot said levers toward and away from said wound roll to selectively and responsively press with an adjustable force said relief drum against said wound roll during winding.

* * * * *